US011643857B2

(12) United States Patent
Konrad et al.

(10) Patent No.: US 11,643,857 B2
(45) Date of Patent: May 9, 2023

(54) VEHICLE DOOR FOR A MOTOR VEHICLE

(71) Applicant: DAIMLER AG, Stuttgart (DE)

(72) Inventors: Tobias Konrad, Böblingen (DE); Martin Lindmayer, Sulz (DE)

(73) Assignee: MERCEDES-BENZ GROUP AG, Stuttgart (DE)

( * ) Notice: Subject to any disclaimer, the term of this patent is extended or adjusted under 35 U.S.C. 154(b) by 167 days.

(21) Appl. No.: 17/414,474

(22) PCT Filed: Oct. 25, 2019

(86) PCT No.: PCT/EP2019/079239
§ 371 (c)(1),
(2) Date: Jun. 16, 2021

(87) PCT Pub. No.: WO2020/126173
PCT Pub. Date: Jun. 25, 2020

(65) Prior Publication Data

US 2022/0074245 A1 Mar. 10, 2022

(30) Foreign Application Priority Data

Dec. 19, 2018 (DE) ..... 10 2018 010 026.0

(51) Int. Cl.
*E05B 85/10* (2014.01)
*E05B 81/20* (2014.01)
(Continued)

(52) U.S. Cl.
CPC ..... *E05B 85/107* (2013.01); *E05B 81/20* (2013.01); *E05F 15/53* (2015.01); *E05F 15/611* (2015.01)

(58) Field of Classification Search
CPC ..... E05B 85/10; E05B 85/107; E05B 5/00; E05B 5/003; B60J 5/0468
(Continued)

(56) References Cited

U.S. PATENT DOCUMENTS 3,398,484 A * 8/1968 Katsumura ..... E05F 15/622 49/281
5,369,911 A * 12/1994 Fortunato ..... G07C 9/00182 49/357
(Continued)

FOREIGN PATENT DOCUMENTS

DE 2854423 C2 12/1986
DE 3915737 A1 11/1990
(Continued)

OTHER PUBLICATIONS

International Search Report dated Jan. 30, 2020 in related/corresponding International Application No. PCT/EP2019/079239.
(Continued)

*Primary Examiner* — Carlos Lugo
(74) *Attorney, Agent, or Firm* — Patent Portfolio Builders PLLC

(57) ABSTRACT

A motor vehicle door includes a door handle unit fixed on the inside on the door edge opposite a door hinge. The door handle unit is motorically pivotable between a folded-in and a folded-out position. In the folded-in position when the vehicle door is closed the door handle unit is arranged behind the vehicle door. In the folded-out position, the door handle unit protrudes laterally outwards by surrounding the door edge and is grippable to open the door. A door mover unit is configured to move the vehicle door in a closed state out of a closed position into a stand-by position, in which the door handle unit can be moved from the folded-in position into the folded-out position. A control unit has a signal input which, upon obtaining the opening signal, controls the door mover unit to move into the stand-by position and controls the door handle unit to pivot into the folded-out position.

5 Claims, 3 Drawing Sheets

Figure 1:
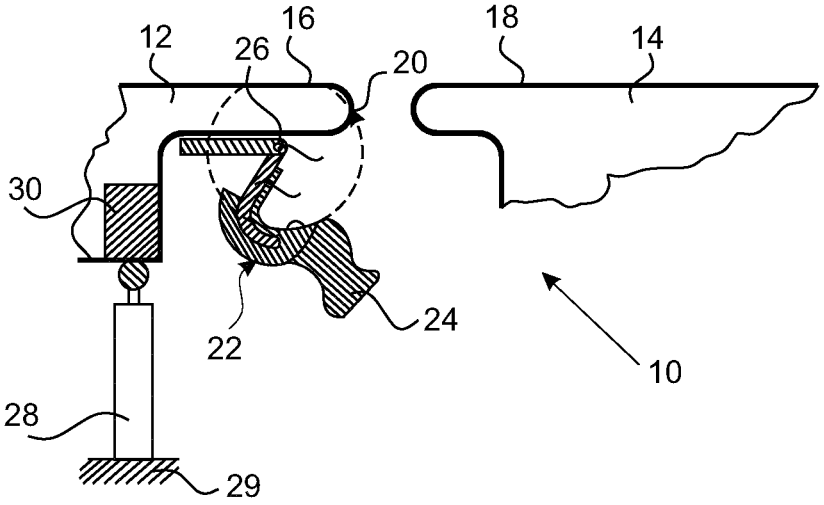

(51) Int. Cl.
*E05F 15/53* (2015.01)
*E05F 15/611* (2015.01)

(58) Field of Classification Search
USPC ..... 296/146.1, 146.4, 146.9
See application file for complete search history.

(56) References Cited

U.S. PATENT DOCUMENTS

| | | | | |
|---|---|---|---|---|
| 6,711,856 | B1 * | 3/2004 | Hoffman | E05F 1/105 49/386 |
| 6,752,440 | B2 * | 6/2004 | Spurr | E05B 83/38 292/336.3 |
| 7,784,841 | B2 * | 8/2010 | Watson | E05B 79/20 292/DIG. 31 |
| 8,919,047 | B2 | 12/2014 | Johnsrud et al. | |
| 9,771,750 | B2 * | 9/2017 | Held | E05F 1/105 |
| 9,995,066 | B1 * | 6/2018 | Ottolini | E05F 15/619 |
| 10,590,677 | B2 | 3/2020 | Papanikolaou et al. | |
| 10,633,893 | B2 * | 4/2020 | Harajli | E05B 81/20 |
| 10,711,504 | B2 * | 7/2020 | Roos | E05B 81/14 |
| 11,008,797 | B2 * | 5/2021 | Termine | E05F 15/622 |
| 11,486,173 | B2 * | 11/2022 | Marcolino Quintao Severgnini | B60R 25/31 |
| 2017/0130490 | A1 * | 5/2017 | Wirths | E05B 81/20 |
| 2018/0058128 | A1 * | 3/2018 | Khan | E05F 15/42 |
| 2020/0263459 | A1 * | 8/2020 | Debroucke | E05B 81/20 |

FOREIGN PATENT DOCUMENTS

| | | | | |
|---|---|---|---|---|
| DE | 19740827 | A1 | 3/1999 | |
| DE | 29812121 | U1 | 11/1999 | |
| DE | 19835994 | A1 | 2/2000 | |
| DE | 10128014 | A1 | 12/2002 | |
| DE | 102004031798 | A1 | 1/2006 | |
| DE | 102011119579 | A1 | 5/2013 | |
| DE | 102013215896 | A1 | 2/2014 | |
| DE | 202017103702 | U1 | 7/2017 | |
| DE | 102016118685 | A1 * | 4/2018 | B60J 5/0415 |
| WO | WO-2015062580 | A1 * | 5/2015 | E05B 17/10 |

OTHER PUBLICATIONS

Office Action dated Aug. 8, 2019 in related/corresponding DE Application No. 10 2018 010 026.0.

Written Opinion dated Jan. 30, 2020 in related/corresponding International Application No. PCT/EP2019/079239.

* cited by examiner

VEHICLE DOOR FOR A MOTOR VEHICLE

BACKGROUND AND SUMMARY OF THE INVENTION

Exemplary embodiments of the invention relate to a vehicle door fora motor vehicle having a door handle which, in the closed state, is not accessible from the outside.

Various solutions for this are known, wherein the door handle is often arranged so as to be able to be countersunk in a hollow, such as is known from DE 20 2017 103 702 U1 or DE 10 2013 215 896 A1, for example.

Furthermore, a door edge protector that can fold out outwardly is known from DE 10 2004 031 798 A1, which is fixed on the inside on the door edge opposite a door axis and can be pivoted from a folded-in position to a folded-out position by a movement forcibly coupled to a pivoting movement of the vehicle door. The door edge protector protectively surrounds the door edge in the folded-out position, in order to avoid damage to the door edge and to adjacent vehicles in narrow parking spaces.

Exemplary embodiments of the invention are directed to a vehicle door for a motor vehicle in which, in the closed state of the door, the door handle is not visible from outside, yet the vehicle door is nevertheless to be opened conveniently from the outside by means of a manual actuation.

According to embodiments

- a door handle unit, which is fixed on the inside on the door edge opposite a door hinge and can be pivoted motorically between a folded-in and a folded-out position, wherein, in the folded-in position when the vehicle door is closed, the door handle unit is arranged behind it and, in the folded-out position, protrudes laterally outwards by encompassing the door edge and can be manually gripped for opening the door,
- a door mover unit, which is formed to move the vehicle door in a closed position out of a closed position into a stand-by position, in which the door handle unit can be pivoted from the folded-in to the folded-out position,
- a control unit with a signal input, which, upon obtaining the opening signal, controls the door mover unit to move into the standby position and controls the door handle unit to pivot into the folded-out position.

The invention provides a vehicle door for a motor vehicle, in which, when the door is closed, the door handle is arranged to be concealed from the outside completely behind the door, such that the vehicle door does not have any door handle elements visible from the outside, but rather a flat contour. In this position, the door handle is thus in a protected and clean region. In the folded-in state, the door handle is not disruptive and does not require any design space. If the door is to be opened from the outside, the door handle is provided to be easily accessible from the outside by actuating a door opener, preferably a wireless key, after a gap-width opening of the vehicle door, such that the vehicle door can be opened conveniently and ergonomically favorably. According to the invention, this is achieved by the door handle unit being able to be pivoted between two positions and the vehicle door being moved out of the closed position into the stand-by position by the door mover unit, in which stand-by position the vehicle door is opened by a gap which is sufficient for pivoting the door handle unit out into the folded-out or grippable position.

According to an advantageous development of the invention, the door mover unit has a push rod that can be moved laterally with respect to the vehicle. In doing so—after unlocking a door lock—the vehicle door can be moved simply, in terms of construction, out of the closed position into the stand-by position. Particularly preferably, the door mover unit is formed as a threaded drive or gear rack drive.

According to an advantageous development of the invention, the door mover unit is fixed on the vehicle door and is supported on a vehicle chassis. Thus, this can be easily electrically attached to the other components coupled to it, such as the control unit, the door lock, and a drive for the door handle unit, which also simplifies assembly.

According to an alternative development of the invention, the door mover unit is fixed on the vehicle chassis and is supported on the vehicle door. This design enables a greater movement stroke when moving the vehicle door into the stand-by position.

According to a further alternative development of the invention, the door mover unit is arranged on a door hinge and generates a rotational movement of the vehicle door. This can be implemented by means of an arcuate gear rack, which meshes with an electric engine. Alternatively, a hydraulic or pneumatic actuation is possible.

According to an advantageous development of the invention, the door mover unit is set up to move back into a closed position after a manual opening movement, departing from the stand-by position, of the vehicle door. In doing so, it is achieved that the vehicle door can be closed again at any time as needed by a user without leading to damage to the door mover unit, when such a closing movement is carried out immediately or vigorously. Alternatively, the door mover unit can also be provided with means enabling a return movement, caused from the outside, of the door mover unit into the closed position after reaching the final position, i.e., the stand-by position.

According to an advantageous development, the door mover unit has a latch device on the free end, the latch device being formed to come into positive engagement with a counterpiece with its support-side free end before the movement into the closed position, in order to thus create the possibility of pulling the vehicle door shut again out of the stand-by position. When the door mover unit is arranged in the vehicle door, the engagement counterpiece is formed in the chassis and vice versa. This design makes it possible to close the vehicle door again out of the stand-by position by means of the door mover unit, i.e., to pull it shut into the closed position, which is naturally only possible after the door handle unit is moved back out of the folded-out position into the folded-in position. The door mover unit here serves as an opening and closing device for the vehicle door. Such an automatic closing movement can be triggered, in particular, by a radio signal of a remote control or a switching element in the vehicle interior.

The invention also comprises a motor vehicle having a vehicle door according to one of the embodiments described above.

A method for operating a vehicle door described above involves:

- providing an opening signal via a manually actuatable switching element or a radio signal,
- unlocking a door lock,
- actuating the door mover unit out of the closed position into the stand-by position,
- waiting until this has been moved a predetermined distance, which defines a sufficiently wide door gap, in order to pivot the door handle unit out of the folded-in position into the folded-out position,
- actuating the door handle unit in order to pivot this out of the folded-in position into the folded-out position.

Further advantages, features and details emerge from the description below, in which—optionally with reference to the drawings—at least one exemplary embodiment is described in detail. Identical, similar and/or functionally identical parts are provided with the same reference numerals.

BRIEF DESCRIPTION OF THE DRAWING FIGURES

Figure 2:
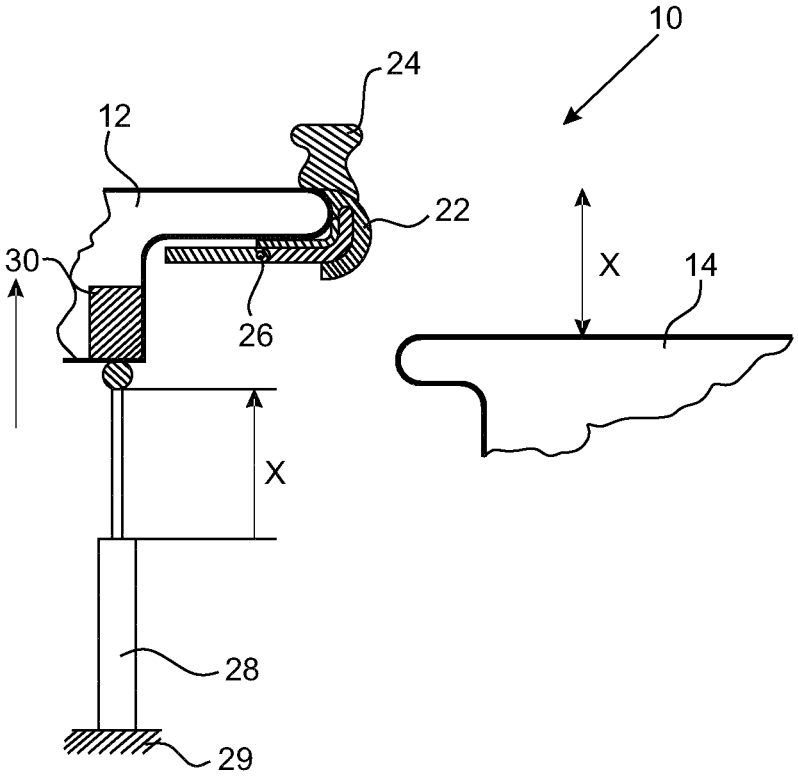
Figure 3:
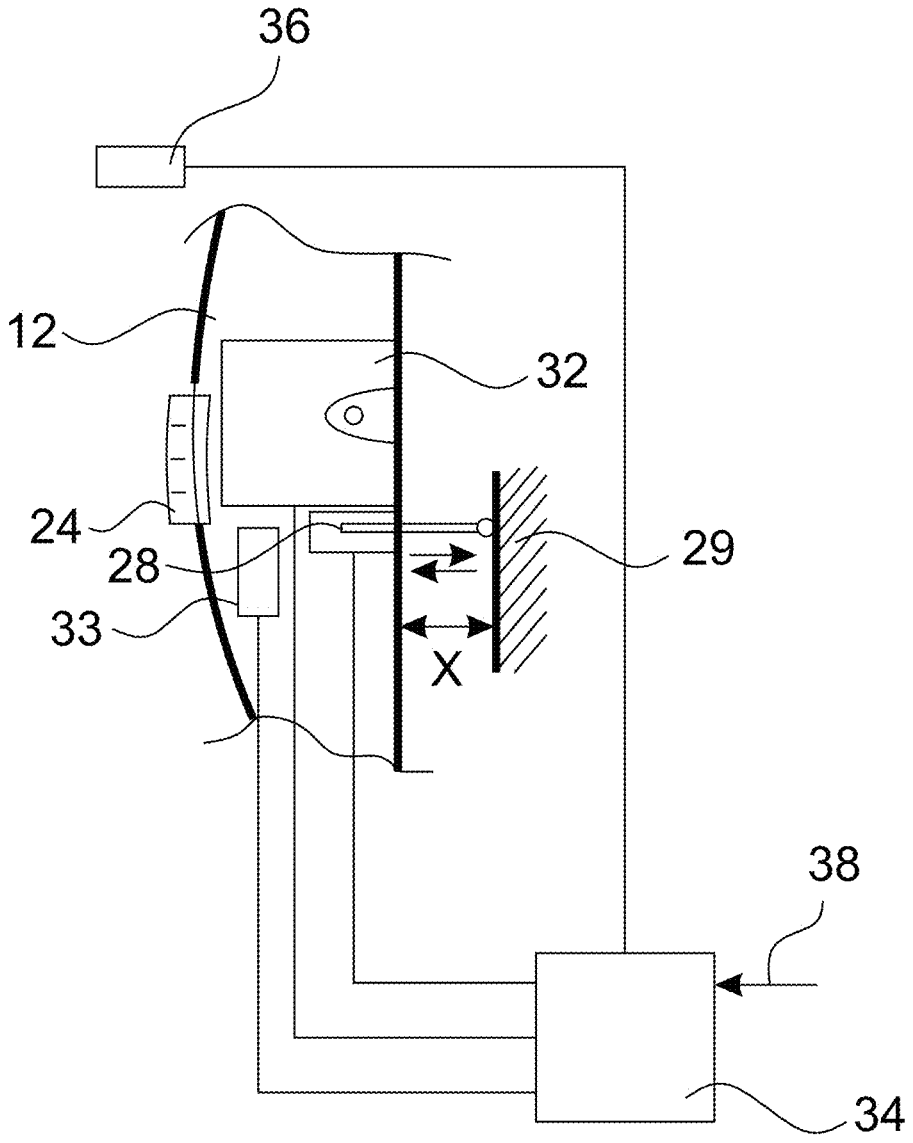
Figure 4:
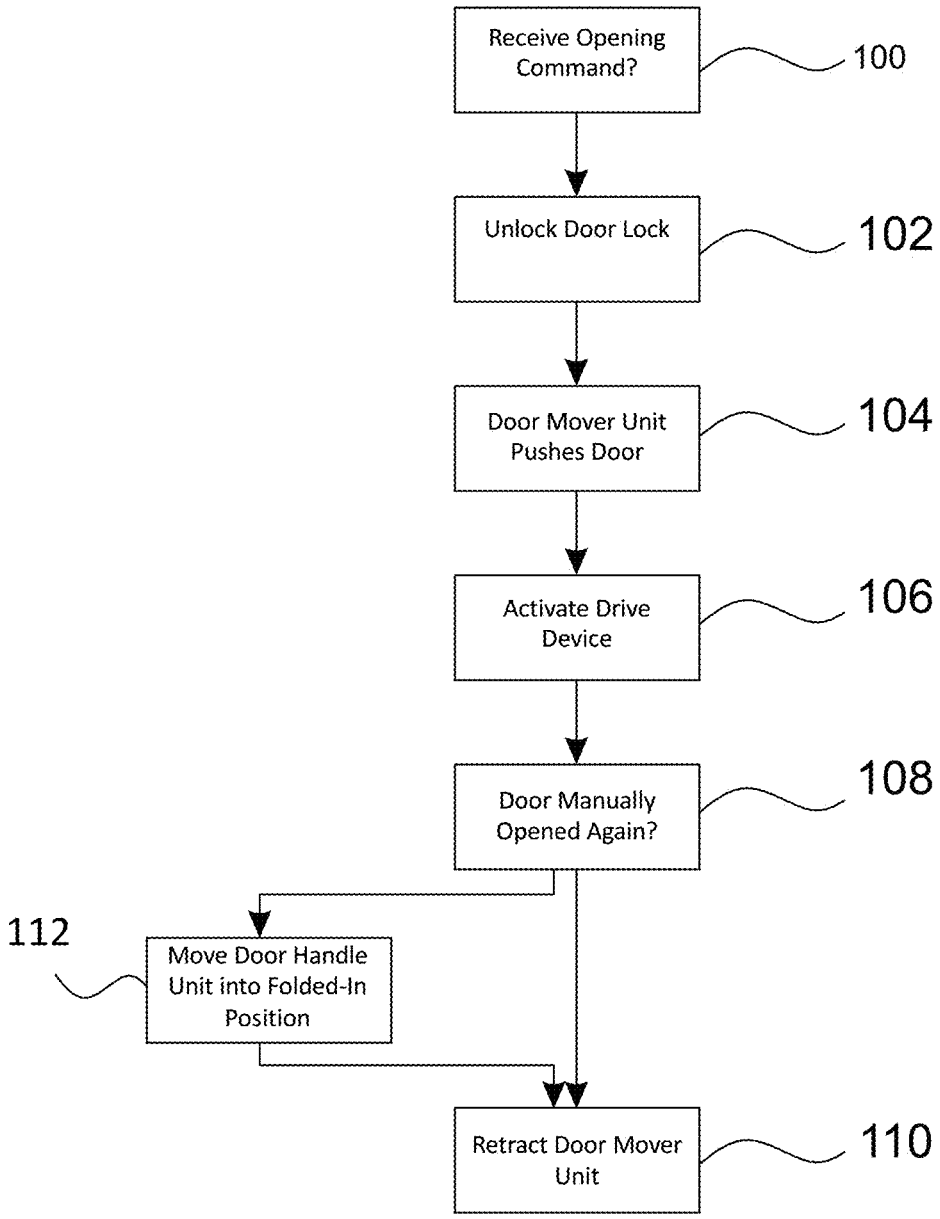

Here are shown:

FIG. 1: a schematic sectional depiction of a door handle device in the folded-in state, FIG. 2: a schematic sectional depiction of the same door handle device in the folded-out state, FIG. 3: a schematic sectional depiction through a vehicle door, FIG. 4: a flow diagram during the opening or closing process of the vehicle door.

DETAILED DESCRIPTION

A door handle device 10 for opening a vehicle door 12 of a motor vehicle (not depicted in more detail), is in FIGS. 1 and 2, of which only one chassis part 14, for example a part of a B-pillar, is depicted.

In FIG. 1, the vehicle door 12 is shown in the closed state, such that its exterior surface 16 is flush with the exterior surface 18 of the chassis 14. The vehicle door 12 is formed relatively thinly in the region of its rear edge 20. In this region, a door handle unit 22 is fixed on the inside, which comprises a door handle 24, which can be pivoted around a pivot axis 26, which runs in parallel to the rear edge 20. In this figure, the door handle unit 22 is shown in the folded-in position in which the door handle 24 protrudes inwardly.

In FIG. 2, the door handle unit 22 is shown in the folded-out position in which the door handle 24 is pivoted or folded out by c. 120° outwardly around the door rear edge 20. Here, the door handle unit 22 has a shape adhering to the shape of the vehicle door 12 in the region of the door rear edge 20 and, in the contact region, preferably has an elastic material layer, in order to cushion the pivoting movement and to avoid damage of the door rear edge 20. The folding movement of the door handle unit 22 is caused by a preferably electromotive adjustment device (not depicted). A spring device can also be installed, such that a return folding movement of the door handle unit 22 in the one direction can automatically be carried out by spring force, e.g., the pivoting movement out of the folded-out position into the folded-in position.

In FIGS. 1 and 2, a translational door mover unit 28 is furthermore depicted, which is attached to the vehicle chassis 29 via fixing means not depicted in more detail (e.g., in the foot rocker panels), which is supported on a strengthening part 30 of the vehicle door 12. In FIG. 1, the door mover unit 28 is depicted in the retracted state, i.e., when the vehicle door 12 is closed.

In FIG. 2, the vehicle door 12 is shown in the stand-by position, in which the rear door edge is shifted laterally outwards by a distance X. In fact, the vehicle door 12 naturally pivots around a rotational axis, not shown, in door hinges, which is caused by the door mover unit 28 being extended by the distance X after unlocking a door lock and thus the vehicle door 12 shifting laterally outwards. The distance X is measured here in such a way that the door handle unit can fold out without the door handle 24 abutting on the chassis part 14.

In FIG. 3, a section of the vehicle door 12 is shown on a lateral plane. In this design, the door mover unit 28 is arranged in the vehicle door 12, which is supported on the vehicle chassis 29. In this figure, a door lock 32 for the vehicle door 12 is also depicted, as well as a drive device 33 for the door handle unit 22.

An electronic control unit 34 is electrically connected to the door lock 32, the door mover unit 28, the drive device 33 for the door handle unit 22, and a switching element 36. The switching element 36 (e.g., a button) is preferably located in the vehicle interior, in order to move the vehicle door 12 into the stand-by position (FIG. 2) from the inside. A switching element 36 accessible from the outside can additionally be provided, which, in a similar manner, can move the vehicle door 12 into the stand-by position from the outside when the door lock is not bolted.

Furthermore, the control unit 34 can have a signal input 38 for receiving opening or closing signals by means of a remote control.

The opening procedure carried out by the control unit 34 is depicted in FIG. 4.

In step 100, when the vehicle door 12 is closed (FIG. 1), it is checked as to whether an opening command from the switching element 36 or signal input 38 is present. If this is the case, in step 102, the door lock 32 is unlocked by the control unit 34 and then, in step 104, the door mover unit 28 is put into motion, such that it pushes the vehicle door 12 in the closed state out of the closed position shown in FIG. 1 into the stand-by position shown in FIG. 2 and FIG. 3. Then, in step 106, the drive device 33 is activated, which moves the door handle unit 22 from the internal, folded-in position shown in FIG. 1 by c. 120° outwards into the folded-out position shown in FIG. 2.

In this state, the door handle 24 can be gripped by a person located outside, and the vehicle door 12 can be opened completely.

In step 108, in an embodiment with the vehicle door 12 in the stand-by position, it is checked as to whether the vehicle door 12 has been manually opened again. If this is the case, in step 110, the door mover unit 28 is retracted again, such that a manual closing of the vehicle door 12 can be carried out in an unimpeded manner by slamming from the outside or pulling shut from the inside.

However, in the state of the vehicle door 12 in the stand-by position, if it is established in step 108 that an actuation signal has been obtained via the switching element 36 or the signal input 38, then, in step 112, the drive device 36 is prompted to move the door handle unit 22 back into the folded-in position (FIG. 1), and then, in step 110, the door mover unit 28 is retracted again. In one embodiment, the door mover unit 28 can be formed in such a way that its retraction pulls the vehicle door 12 shut again. A timer can also be integrated in the control unit 34, which automatically pulls the vehicle door 12 shut again when a manual opening movement of the vehicle is not carried out for a certain period of time (e.g., 10-60 sec).

Although the invention has been illustrated and explained in more detail by means of preferred exemplary embodiments, the invention is not limited by the disclosed examples, and other variations can be derived from this by the person skilled in the art, without leaving the protected scope of the invention. It is thus clear that a plurality of variation possibilities exist. It is also clear that the embodiments mentioned by way of example really only constitute examples which cannot be interpreted in any way as limiting, for example, the protective scope, the application possibilities, or the configuration of the invention. Instead, the description above and the description of the figures put the person skilled in the art in the position to concretely implement the exemplary embodiments, wherein the person skilled in the art, with the knowledge of the inventive concept disclosed, can undertake various changes, for example in terms of the function or the arrangement of individual elements mentioned in an exemplary embodiment without leaving the scope of protection, which is defined by the claims and their legal equivalents.

The invention claimed is:

1. A vehicle door for a motor vehicle, the vehicle door comprising:

a door handle unit fixed on an inside on a door edge of the vehicle door opposite a door hinge, wherein the door handle unit is motorically pivotable between a folded-in and a folded-out position, wherein the door handle unit, in the folded-in position when the vehicle door is closed, is arranged behind the vehicle door and, in the folded-out position, the door handle unit protrudes laterally outwards by surrounding the door edge and the door handle unit is grippable to manually open the door;

a door mover unit configured to move the vehicle door in a closed state out of a closed position into a stand-by position in which the door handle unit is moveable from the folded-in position into the folded-out position, wherein the door mover unit has a push rod that is laterally movable with respect to the vehicle, and wherein the door mover unit comprises a threaded drive or a gear rack drive coupled to the push rod, and wherein the door mover unit is fixed on the vehicle chassis and is supported on the vehicle door; and a control unit having a signal input, wherein the control unit is configured, upon obtaining an opening signal, to control the door mover unit to move into the stand-by position and to control the door handle unit to pivot into the folded-out position, wherein the door handle unit has a shape adhering to a shape of the vehicle door in a region of a rear edge of the vehicle door and contact an elastic material layer on the rear edge of the vehicle door.

2. The vehicle door of claim 1, wherein the door mover unit is configured to move back into the closed position after a manual opening movement, departing from the stand-by position, of the vehicle door.

3. The vehicle door of claim 1, wherein upon obtaining a closing signal, the control unit is configured to control the door handle unit to pivot into the folded-in position and is configured to control the door mover unit to move the vehicle door into the closed position.

4. A method for operating a vehicle door, the method comprising:

providing an opening signal via a manually actuatable switching element or a radio signal;

unlocking a door lock of the vehicle door responsive to the opening signal;

actuating a door mover unit to move the vehicle door out of a closed position into a stand-by position, wherein the door mover unit has a push rod that is laterally movable with respect to the vehicle, and wherein the door mover unit comprises a threaded drive or a gear rack drive coupled to the push rod, and wherein the door mover unit is fixed on the vehicle chassis and is supported on the vehicle door;

actuating a door handle unit in to pivot the door handle unit out of a folded-in position into a folded-out position, wherein the actuation of the door handle unit occurs after the vehicle door has moved a predetermined distance that provides a gap between the vehicle door and a chassis part that is adjacent to the vehicle door, and wherein the gap is large enough so that the door handle unit is pivotable out of the folded-in position into the folded-out position without abutting the chassis part, wherein the door handle unit has a shape adhering to a shape of the vehicle door in a region of a rear edge of the vehicle door and contact an elastic material layer on the rear edge of the vehicle door.

5. A motor vehicle, comprising:

a vehicle door, wherein the vehicle door comprises a door handle unit fixed on an inside on a door edge of the vehicle door opposite a door hinge, wherein the door handle unit is motorically pivotable between a folded-in and a folded-out position, wherein the door handle unit, in the folded-in position when the vehicle door is closed, is arranged behind the vehicle door and, in the folded-out position, the door handle unit protrudes laterally outwards by surrounding the door edge and the door handle unit is grippable to manually open the door;

a door mover unit configured to move the vehicle door in a closed state out of a closed position into a stand-by position in which the door handle unit is moveable from the folded-in position into the folded-out position, wherein the door mover unit has a push rod that is laterally movable with respect to the vehicle, and wherein the door mover unit comprises a threaded drive or a gear rack drive coupled to the push rod, and wherein the door mover unit is fixed on the vehicle chassis and is supported on the vehicle door; and a control unit having a signal input, wherein the control unit is configured, upon obtaining an opening signal, to control the door mover unit to move into the stand-by position and to control the door handle unit to pivot into the folded-out position, wherein the door handle unit has a shape adhering to a shape of the vehicle door in a region of a rear edge of the vehicle door and contact an elastic material layer on the rear edge of the vehicle door.

* * * * *